US010966503B1

(12) United States Patent
Robinson et al.

(10) Patent No.: US 10,966,503 B1
(45) Date of Patent: Apr. 6, 2021

(54) EYE MAKE-UP APPLICATOR AND METHOD OF USE

(71) Applicants: Desiree Robinson, Fort Worth, TX (US); Carol Robinson, Fort Worth, TX (US)

(72) Inventors: Desiree Robinson, Fort Worth, TX (US); Carol Robinson, Fort Worth, TX (US)

( * ) Notice: Subject to any disclaimer, the term of this patent is extended or adjusted under 35 U.S.C. 154(b) by 226 days.

(21) Appl. No.: 15/914,495

(22) Filed: Mar. 7, 2018

Related U.S. Application Data

(60) Provisional application No. 62/529,632, filed on Jul. 7, 2017.

(51) Int. Cl.
*A45D 7/00* (2006.01)
*A45D 40/26* (2006.01)
*A45D 34/04* (2006.01)

(52) U.S. Cl.
CPC .... *A45D 34/045* (2013.01); *A45D 2200/1018* (2013.01); *A45D 2200/1072* (2013.01)

(58) Field of Classification Search
CPC ..... A45D 34/00; A45D 34/045; A45D 34/06; A45D 37/00; A45D 2040/0012; A45D 3034/005; A45D 3034/007; A45D 40/24; A45D 40/265; A45D 40/28; A45D 2200/1009; A45D 2200/1018; A45D 2200/1036; A45D 2200/1072
USPC ..... 401/17, 23, 199
See application file for complete search history.

(56) References Cited

U.S. PATENT DOCUMENTS 3,922,100 A * 11/1975 Saito ..... B43K 8/003 401/199
5,813,787 A * 9/1998 Dowzall ..... B43K 5/1845 401/18
9,554,635 B1 * 1/2017 Liu ..... B43K 8/06
2003/0231919 A1 * 12/2003 Kim ..... B43K 27/04 401/23
2007/0077112 A1 * 4/2007 Santamaria ..... A45D 40/24 401/17
2016/0081456 A1 * 3/2016 Grund ..... A45D 34/06 132/200
2017/0156474 A1 * 6/2017 Djarar Fischer ..... A45D 40/30
2017/0303665 A1 * 10/2017 Ashburn ..... A45D 34/042

* cited by examiner

*Primary Examiner* — Rachel R Steitz
(74) *Attorney, Agent, or Firm* — Richard Eldredge; Leavitt Eldredge law Firm

(57) ABSTRACT

An eyeliner make-up applicator includes a cylindrical body having a first end and a second end; a first stamp portion integral with the first end and having a first stamp; a second stamp portion integral with the second end and having a second stamp; a first cap to removably secure over the first stamp portion; and a second cap to removably secure over the second stamp portion; eyeliner liquid is contained within the cylindrical body and is in fluid communication with the first stamp and the second stamp. The applicator includes a first tip portion having an inkpad in fluid communication with the first stamp and the eyeliner liquid contained within the cylindrical body.

4 Claims, 9 Drawing Sheets

EYE MAKE-UP APPLICATOR AND METHOD OF USE

BACKGROUND

1. Field of the Invention

The present invention relates generally to make-up applicators and methods of use. More specifically, the invention is related to a system and method to apply eyeliner in the cat-eye or winged tip style.

2. Description of Related Art

Systems and methods for applying eyeliner is well known in the art. At times, it is desired to apply eyeliner in certain patterns or styles. For example, a person may apply eye make-up by drawing lines above, below or around the eye using a eyeliner pen or pencil. To achieve a cat-eye or winged tip styled look, the person must draw a line of variant thickness so as to extend past the corner of the eye. There are many types of eyeliner applicators including eyeliner pens, pencils or brushes to be used in conjunction with gel or other ink. FIG. 1 depicts a commonly used eye-liner pencil someone might use to apply eyeliner in the cat-eye style.

Several problems are commonly associated with the eye-make up applicator depicted in FIG. 1 and other commonly used eyeliner tools. For example, it is difficult to free hand draw eyeliner onto specific portions of the eye. During application, it is common to draw a line that is too thick or too thin or draw the eyeliner onto portions of the eye that were not originally intended. Additionally, once eyeliner has been applied to one eye, it is difficult to replicate an exact mirror image of the make-up style onto the other eye.

Although great improvements have been made in the area of eye-make up applicators and methods of use, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
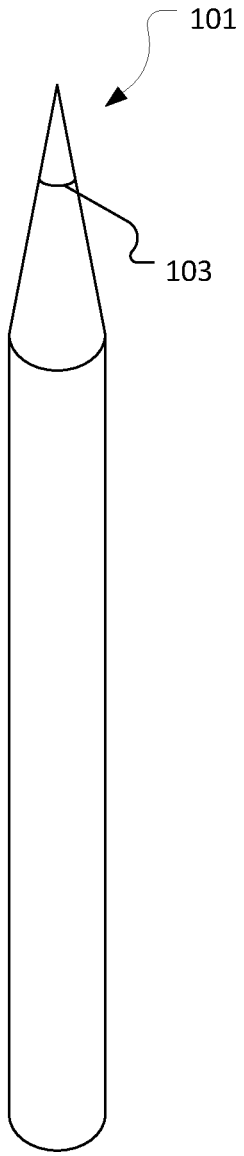
FIG. 1 (Prior Art)
FIG. 1 is a front view of a conventional eyeliner pencil.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional systems and methods to apply eye makeup. Specifically, the present invention is directed to an eyeliner make-up applicator for use in applying eye make-up in the cat eye style. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Referring now to the drawings wherein like reference characters identify corresponding or similar elements throughout the several views. It will be appreciated that applicator 201 overcomes one or more of the above-listed problems commonly associated with the conventional systems and methods to apply cat-eye styled eyeliner.

In the preferred embodiment, eyeliner applicator 201 includes a first end 203 and a second end 205, integral with a body 206 wherein each end has a tip component 207, 209 and a stamp component 211, 213. In the preferred embodiment, first end 203 includes a fine tip 207 for providing a means for precise lining of the user's eye, while end 205 includes a thicker tip 209 for more dramatic and thick lining. In the preferred embodiment, first end 203 includes stamp 211 being shaped appropriately to allow the user to stamp their left eye lid in the common "cat eye" style. Similarly, end 205 includes stamp 213 being appropriately shaped to stamp the user's right eye lid in the cat eye style.

It should be appreciated that body 206 provides a reservoir to contain the eye-liner liquid, which is in fluid communication with tips 207, 209, and stamps 211, 213.

Figure 2A:
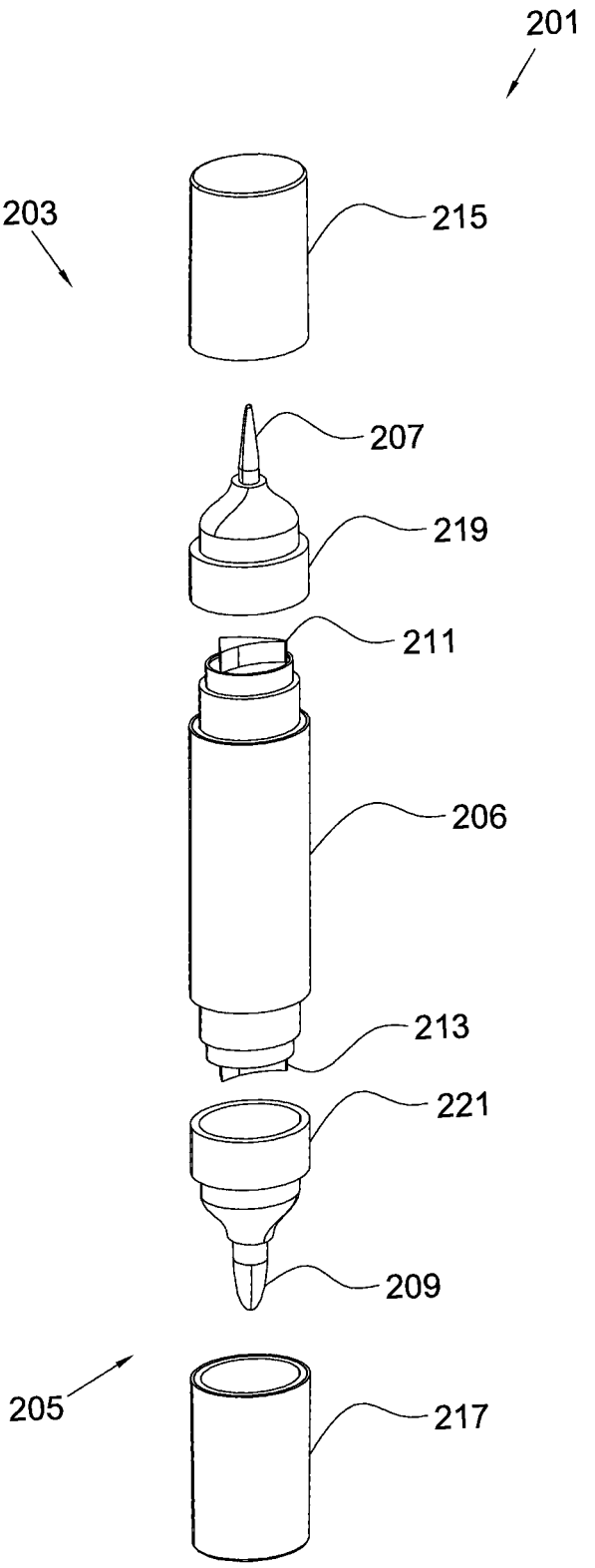
FIGS. 2A and 2B are exploded views of an eye liner applicator in accordance with a preferred embodiment of the present application.
Figure 2B:
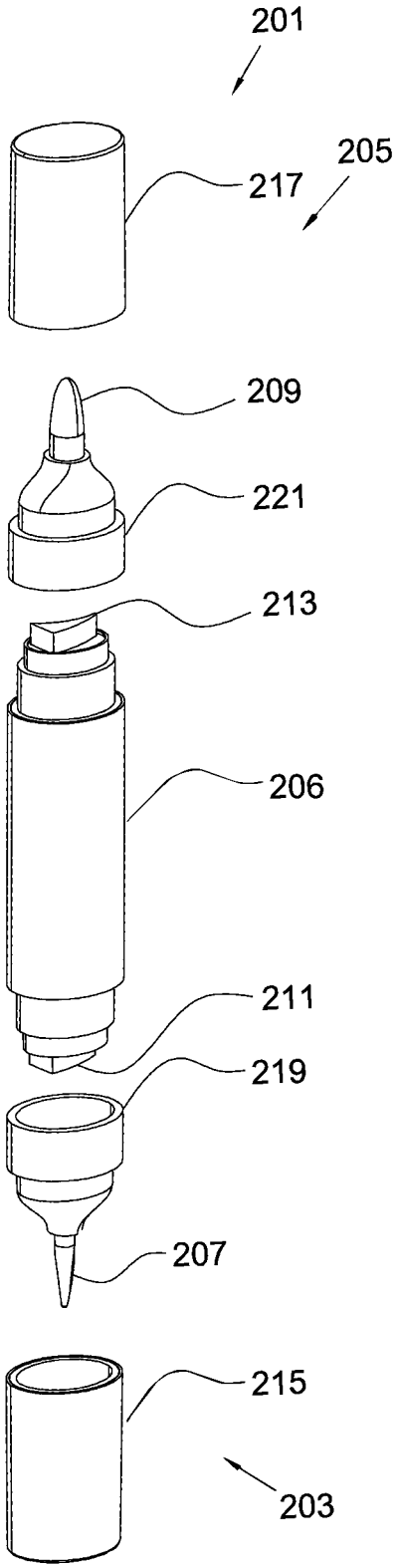

As further shown, applicator 201 includes caps 215, 217 to secure to body 206 over the tips and stamps. In addition, as shown in FIGS. 2A and 2B, tips 207, 209 are connected to a secondary cap 219, 221 configured to secure over and enclose the stamps 211, 213.

Figure 3A:
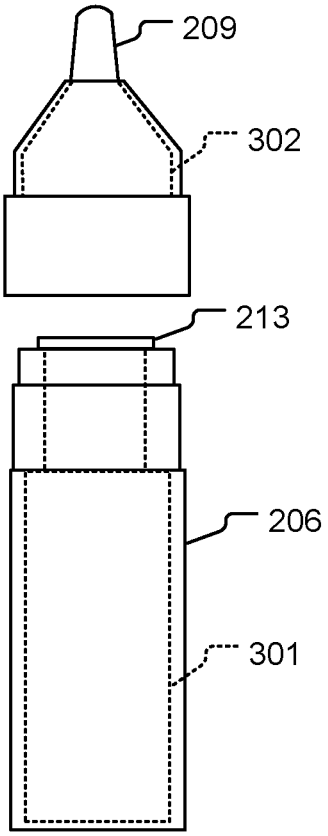
FIGS. 3A and 3B are side views showing the transfer of ink within the applicator of FIGS. 2A and 2B.
Figure 3B:
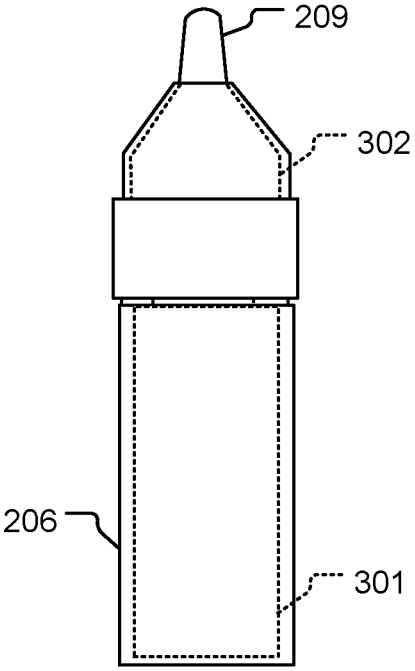

In FIGS. 3A and 3B, the method of transfer of ink from body 206 to one tip 209 is shown. It should be appreciated that an ink reservoir 301 is contained within the inside of body 206 and extends to stamp 213. In addition, an inkpad 302 is positioned in fluid communication with tip 209, wherein the ink pad receives ink from the reservoir 301 and stamp 213. It should be appreciated that this feature is repeated on the opposite end of applicator 201.

Figure 4A:
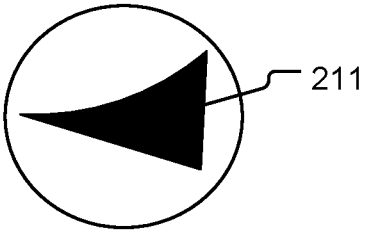
FIGS. 4A and 4B are top views of the first stamp and second stamp of FIGS. 2 and 3 in accordance with the present application.
Figure 4B:
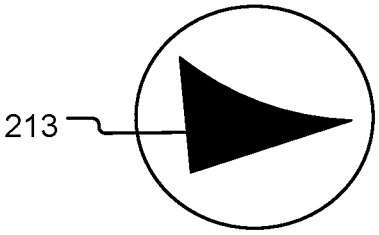

In FIGS. 4A and 4B, end views of stamps 211, 213. As shown, the shape of stamp 211 is appropriate for stamping the left eyelid, whereas the shape of stamp 213 is appropriate for the right eyelid. It should be appreciated that the overall dimensions and exact shape can vary for aesthetical, functional, or manufacturing considerations.

Figure 5:
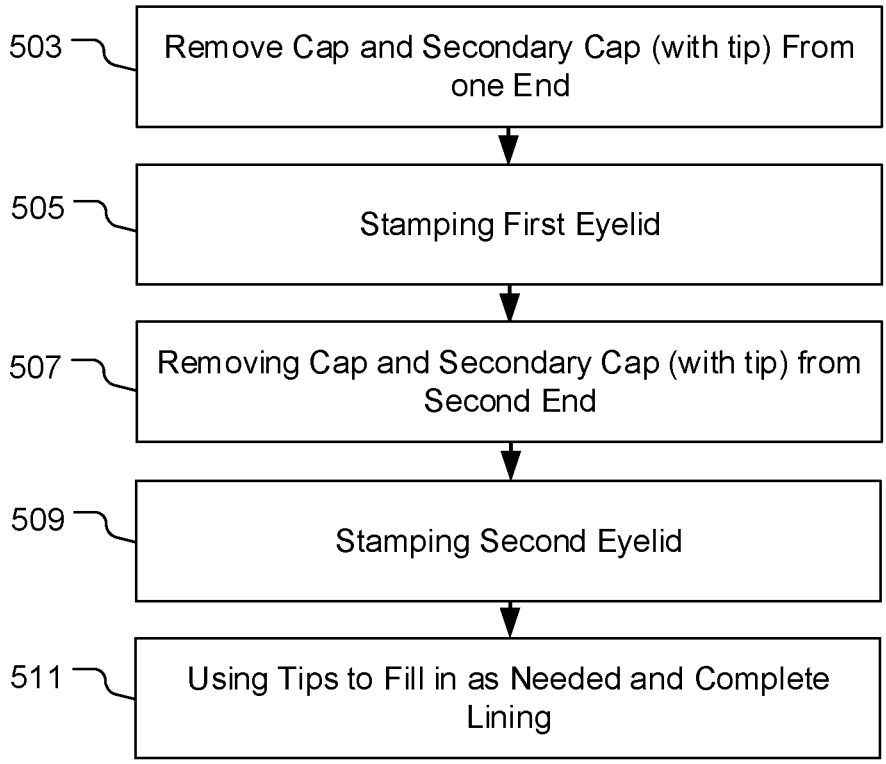
FIG. 5 is a flowchart of a method of use of the eye-liner applicator of FIG. 2.
Figure 6:
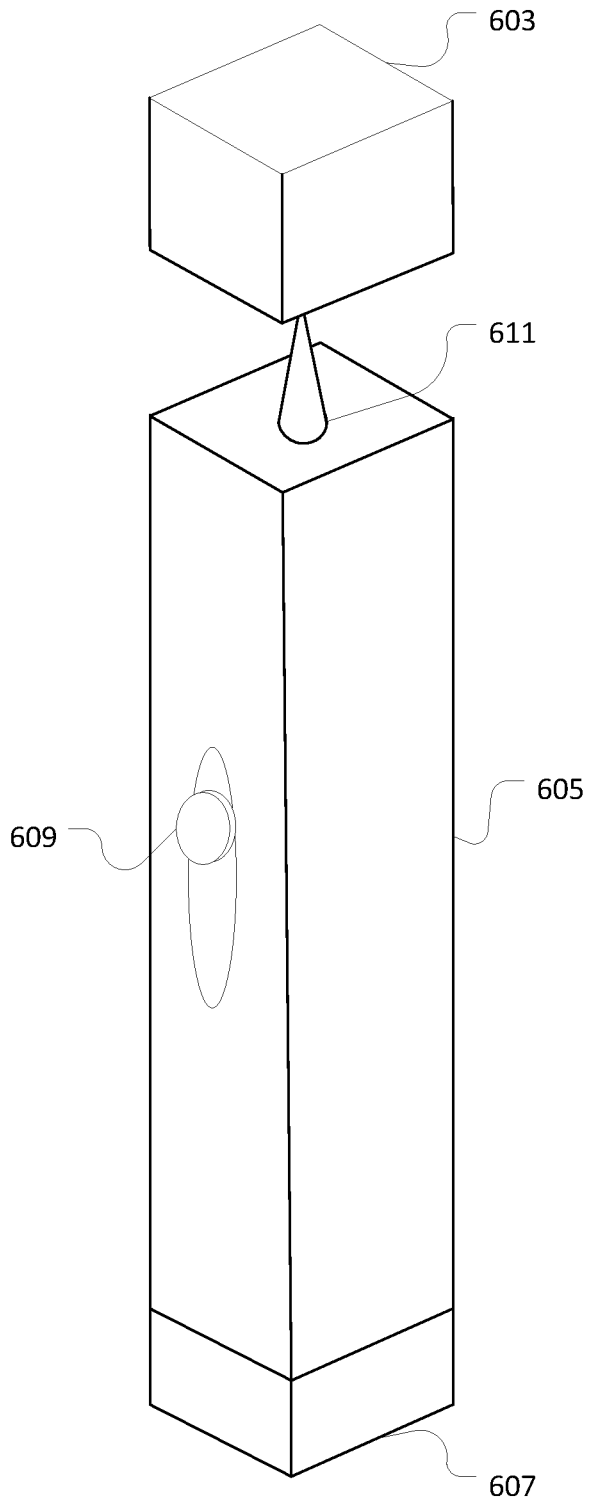
FIG. 6 is an oblique view of an alternative embodiment of an eye-liner applicator in accordance with the present application in a first orientation.

In FIG. 5, a flowchart 501 depicts the method of use of the eyeliner applicator 201. During use, the cap and secondary cap, along with the first tip, are removed from the body, providing access to the first stamp, as shown with box 503. The user then proceeds to stamp their first eyelid, as shown with box 505. The user then repeats the process for the second eyelid, as shown with boxes 507, 509. The user can then replace the caps, and secondary caps, and proceed to remove just the caps to provide access to the tips, wherein the user can use the tips to complete the eye lining process as desired, as shown with box 511.

It should be appreciated that one of the unique features believed characteristic of the present application is the combination of two cat-eye style stamps with eyeliner tips, thereby providing a single apparatus for complete eye lining according to the user's preferences.

In FIGS. 6-9 various views depict an alternative embodiment of an eyeliner applicator 601 in accordance with an alternative embodiment of the present application. It features an outer elongated encasing 605 with a regular tip end cap 603 and a stamp end cap 607. A slide button integrally connected to an eyeliner stamp is shown in the storage position 609. In this embodiment, an eyeliner pen 611 protrudes from a distal end of the applicator tube. It is anticipated that the regular tip end could be an eyeliner pencil, pen or brush tip in alternative embodiments.

Figure 7:
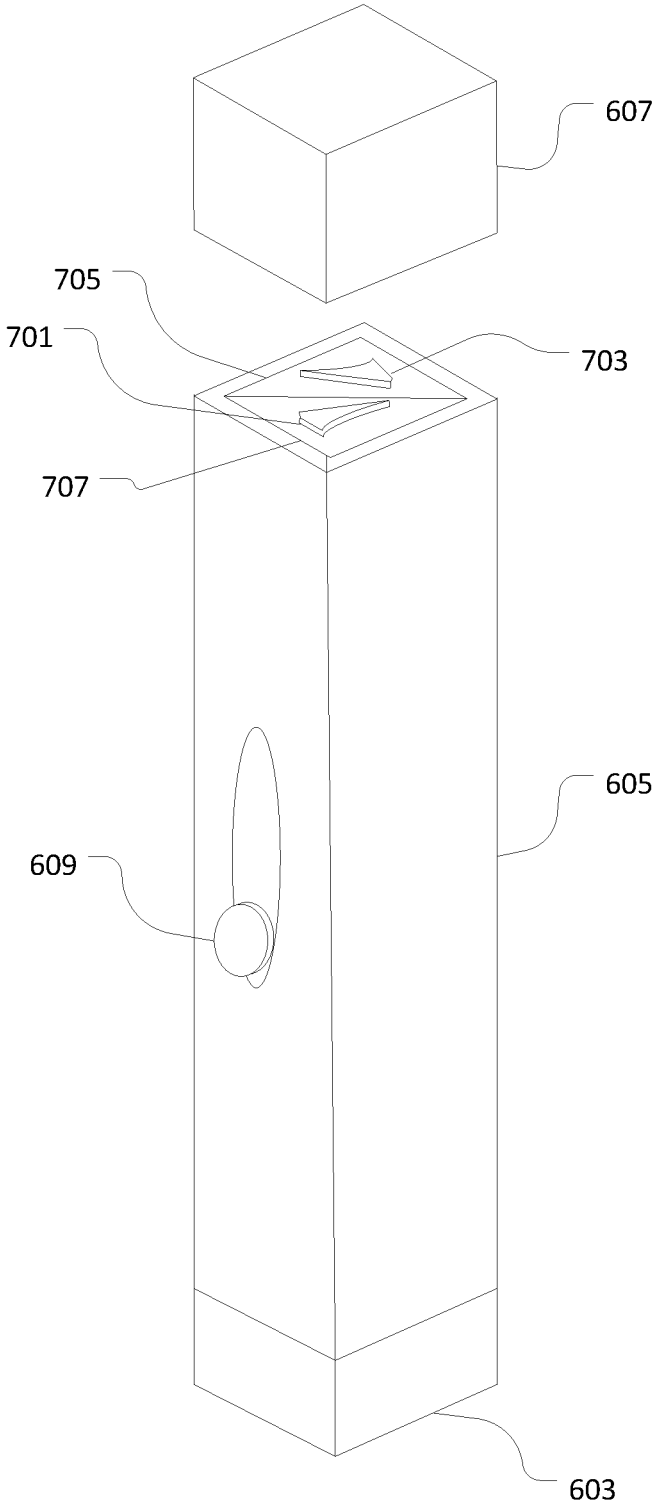
FIG. 7 is an oblique view of the eye-liner applicator of FIG. 6 in a second orientation.

Referring now to FIG. 7, an oblique of the applicator 601, is shown with detail as to the cat-eye style stamp end of the double-ended eye make-up applicator. The stamp end is comprised of two separate stamps, one for the right eye and one for the left eye. The cat-eye style or winged-tip style stamps 701, 703 are located on stamp bases 705,707. The stamp bases 705,707 are triangular and fit together such that they form a rectangle so as to fit inside the outer encasing 607 or applicator tube. It is anticipated that the cat eye stamps 701, 703 could also be located on semi-circles so as to fit together to form a circular shape to fit in a cylindrical applicator encasing.

The bases are integrally connected to their respective slider buttons 609 (and a second slider button not visible but identical in form and function to button 609), wherein to extend the stamp base 705, 707, the user pushes the slider button toward the end of the elongated outer encasing 605 until the cat eye stamp is usable for application to the eye. The right eye stamp 701 and base 707 and the left eye stamp 703 and base 705 are separate components that can move independently from each other, thereby allowing the stamps to be used individually, one at a time.

It is anticipated that the base and stamp material be conducive to ink flow from the reservoir, through the stamp, and applied onto the eye and surrounding skin area. This material should be soft to the touch for comfort, durable and sponge-like. The cat-eye stamp could be made from porous silicon or another open cell structure.

Figure 8:
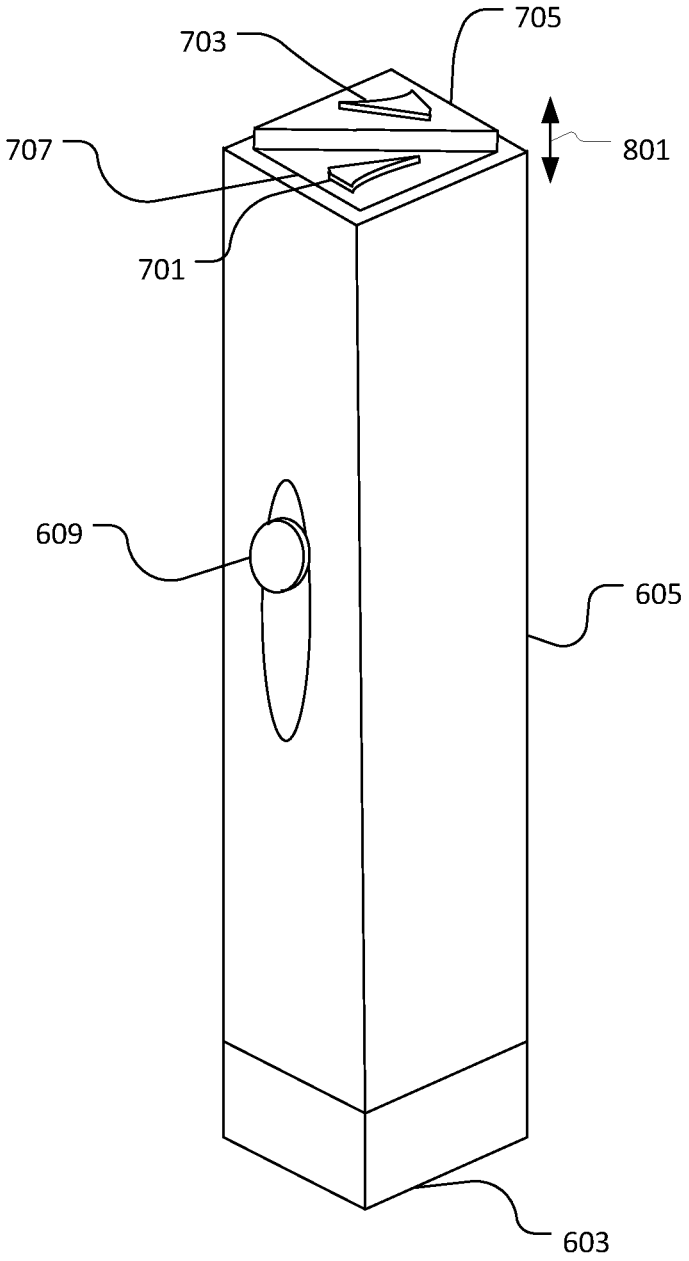
FIG. 8 is an oblique view of the eye-liner applicator of FIG. 6 with a stamp extended.

Referring now to FIG. 8, an oblique view of applicator 601 with details shown as to the working or application position 801 of one of the retractable cat-eye stamps 703. The base is depicted as being raised from the storage position (see FIG. 7) above the other base 707 which is flush with the end of the applicator. The slider button 609 is seen pushed away from its storage position (see FIG. 7) towards the end of the eye-make up applicator 601. To use the other eye stamp 701, it is anticipated that the user would push the button 609 connected to the stamp base 705 down towards the regular tip end of the applicator so as to retract the stamp base until it is flush with the end of the applicator encasing. The user would then push the opposite side slider button (not shown) connected to the other eye stamp 701 towards the stamp end of the applicator until it extends enough to be used for eyeliner application to the eye.

Figure 9:
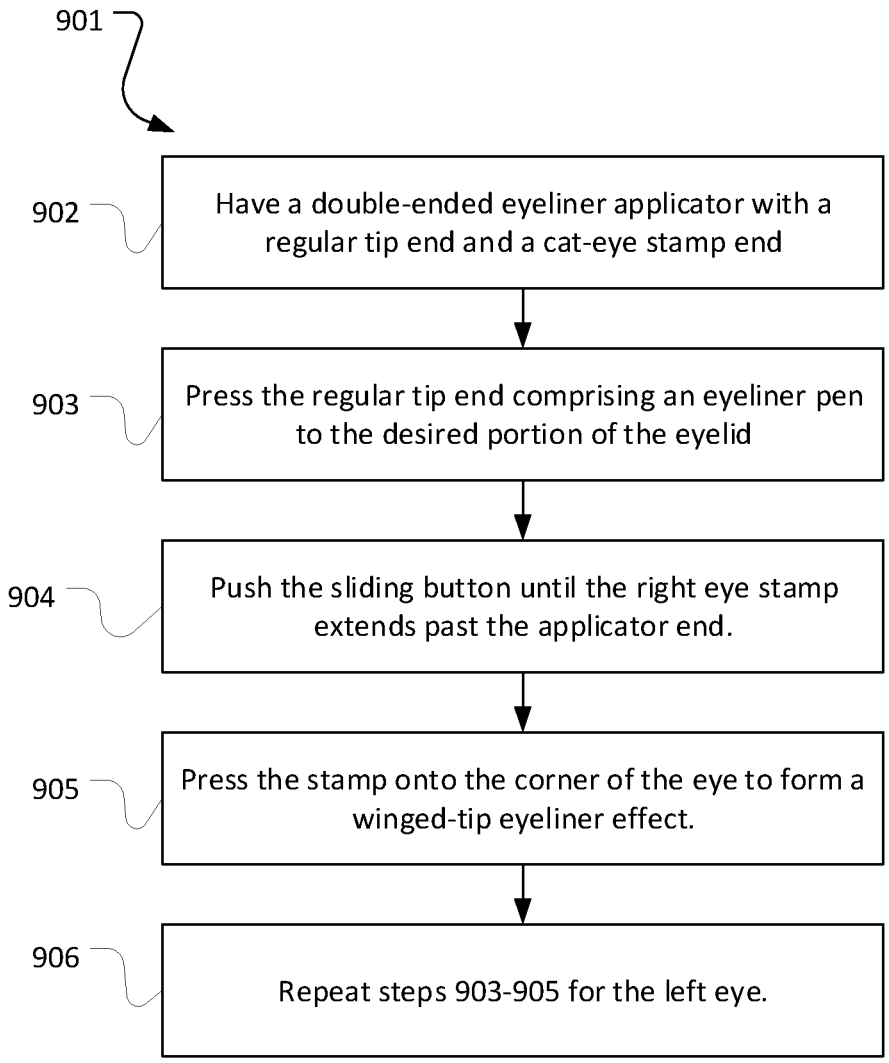
FIG. 9 is a flowchart of the method of use of the eye-liner applicator of FIG. 6.

Referring now to FIG. 9, a method 901 of preferred use is shown as to the present invention. It is anticipated that these steps are one embodiment of the use of the present invention, but the method could omit steps or include additional steps. The method includes: A method of applying eyeliner in the cat-eye or winged tip style comprising: using a double-ended eyeliner make-up applicator having a regular tip end and a stamp end 902, pressing the regular tip end comprising an eyeliner pen point to the desired portions of the eyelid and surrounding skin area 903, pushing the stamp via a sliding button until it protrudes past the end of the applicator 904, pressing the stamp onto the corner of the eye to form a winged-tip eyeliner effect 905. This method is repeated for each eye 906.

Wherein the stamp end of the applicator includes a left and a right eye stamp parts, the method could further include, pressing the right eye stamp onto the corner of the right eye to form a winged tip eyeliner effect and pressing the left eye stamp onto the corner of the left eye to form a winged tip eyeliner effect. The left and right eye stamp portions would be independently retractable via two separate slide buttons located in the outer elongated encasing of the applicator.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An eyeliner make-up applicator, comprising:

a cylindrical body having a first end and a second end, the cylindrical body forming a cavity;

a fluid reservoir positioned within the cavity and is configured to store a fluid;

a first stamp portion integral with the first end and having a first stamp;

a second stamp portion integral with the second end and having a second stamp;

a first cap configured to removably secure over the first stamp portion and configured to removably engage with the first end, the first cap having a first tip, the first tip is in fluid communication with the fluid reservoir;

a second cap configured to removably secure over the second stamp portion and configured to removably engage with the second end, the second cap having a second tip, the second tip is in fluid communication with the fluid reservoir, the second tip has a different geometric shape than the first tip; and a first tip portion configured to removably secure over the first stamp, the first tip portion having an ink pad in fluid communication with the first tip, the ink pad configured to receive eyeliner liquid from the first stamp and the cylindrical body;

wherein eyeliner liquid is contained within the cylindrical body and is in fluid communication with the first stamp and the second stamp.

2. The applicator of claim 1, wherein the first and second stamps are a right eye cat eye stamp and a left eye cat eye stamp.

3. A method of applying eyeliner in the cat-eye or winged tip style comprising:

providing the applicator of claim 1;

removing the first cap and first tip portion, thereby exposing the first stamp; stamping one of the user's right or left eyelids with the first stamp;

removing the second cap and second tip portion, thereby exposing the second stamp;

stamping one of the user's right or left eyelids with the second stamp; removing the first cap to expose the first tip portion; and using the first tip portion to apply additional eyeliner.

4. The method of claim 3, further comprising:

removing the second cap to expose the second tip portion; and using the second tip portion to apply additional eyeliner.

* * * * *